US010207904B2

(12) United States Patent
Morath et al.

(10) Patent No.: US 10,207,904 B2
(45) Date of Patent: Feb. 19, 2019

(54) CRANE, PARTICULARLY CRAWLER CRANE OR MOBILE CRANE

(75) Inventors: Erwin Morath, Ehingen-Lauterach (DE); Peter Abel, Mengen (DE); Edwin Cettinich, Schelklingen-Justingen (DE)

(73) Assignee: LIEBHERR-WERK EHINGEN GMBH, Ehingen (DE)

( * ) Notice: Subject to any disclaimer, the term of this patent is extended or adjusted under 35 U.S.C. 154(b) by 944 days.

(21) Appl. No.: 13/272,744

(22) Filed: Oct. 13, 2011

(65) Prior Publication Data

US 2012/0101694 A1 Apr. 26, 2012

(30) Foreign Application Priority Data

Oct. 14, 2010 (DE) ..... 20 2010 014 309 U

(51) Int. Cl.
*B66C 23/90* (2006.01)

(52) U.S. Cl.
CPC ..... *B66C 23/905* (2013.01)

(58) Field of Classification Search
CPC ..... B66C 23/905; B66C 23/80; B66C 13/16; B66C 2700/08; B60W 2300/16; G05D 2201/0202
USPC ..... 701/36, 50, 124
See application file for complete search history.

(56) References Cited

U.S. PATENT DOCUMENTS 4,063,649 A * 12/1977 Hubbard et al. ..... 212/278
5,730,305 A * 3/1998 Ichiba et al. ..... 212/276
5,823,370 A * 10/1998 Ueda ..... 212/276
6,744,372 B1 * 6/2004 Shaw et al. ..... 340/685
8,195,367 B2 * 6/2012 Kim et al. ..... 701/50
2005/0098520 A1 * 5/2005 Frankenberger ..... B66C 23/905 212/276
2007/0027613 A1 * 2/2007 Abel et al. ..... 701/124
2007/0156280 A1 * 7/2007 Morath ..... 700/213
2008/0004898 A1 * 1/2008 Hubler ..... B66C 23/905 703/7
2008/0061022 A1 * 3/2008 Willim ..... 212/196
2009/0182537 A1 * 7/2009 Kang et al. ..... 703/2
(Continued)

FOREIGN PATENT DOCUMENTS

DE 102005059768 1/2007
EP 1444162 11/2005
JP 09136790 A * 5/1997 ..... B66C 23/82
(Continued)

*Primary Examiner* — Adam D Tissot
*Assistant Examiner* — Aaron C Smith
(74) *Attorney, Agent, or Firm* — Dilworth & Barrese, LLP.; Michael J. Musella, Esq.

(57) ABSTRACT

The invention relates to a [crane], particularly crawler crane or mobile crane, with at least one monitoring and simulation means, by means of which a state of the crane can be monitored and/or simulated, wherein the monitoring and simulation means comprise at least one input means and at least one output means, and wherein, by means of the monitoring and simulation means, the change in state, particularly the bearing load curve of the crane, and particularly also the movement of the crane and/or of the boom of the crane, can be represented at any time, and/or a possible state and/or a possible change in state of the crane, particularly the bearing load curve of the crane, can be simulated and/or represented.

19 Claims, 16 Drawing Sheets

(56) References Cited

U.S. PATENT DOCUMENTS

2011/0087474 A1* 4/2011 Paulsen ..... G05B 17/02
703/7

FOREIGN PATENT DOCUMENTS

JP 10-087281 * 7/1998
WO WO2009/113867 * 9/2009

* cited by examiner

14

[m] END >?<

[m]><[t] CODE>0005< t 201 00014 00.1(3)

| | 32.5 | 32.5 | 10.2 | 13.6 | 13.6 | 17.0 | 20.5 |
|---|---|---|---|---|---|---|---|
| 2.0 | | | 13.9 | 13.5 | 11.7 | 11.4 | 9.1 |
| 2.5 | | | 14.2 | 13.6 | 11.8 | 11.5 | 8.4 |
| 3.0 | | | 14.6 | 13.7 | 12.0 | 11.5 | 7.9 |
| 3.5 | | | 15.1 | 13.7 | 12.4 | 11.4 | 7.7 |
| 4.0 | | | 15.7 | 13.8 | 13.4 | 11.3 | 7.5 |
| 4.5 | 16.1 | 14.0 | 16.6 | 13.9 | 13.7 | 11.3 | 7.3 |
| 5.0 | 14.9 | 13.6 | 18.3 | 14.0 | 13.9 | 11.3 | 7.1 |
| 6.0 | 12.2 | 12.8 | 17.7 | 14.3 | 14.3 | 11.3 | 6.8 |
| 7.0 | 10.1 | 11.3 | 13.4 | 13.4 | 13.4 | 11.3 | 6.5 |
| 8.0 | 8.5 | 9.6 | | 10.6 | 10.6 | 10.2 | 6.3 |
| *n* | *4* | *4* | *5* | *4* | *4* | *3* | *3* |
| 7/16 | << | | | | | | >> |
| % | 100+ | 0+ | 0+ | 0+ | 0- | 46- | 92- |
| | 100+ | 100+ | 0- | 46- | 46+ | 46+ | 46+ |
| | 100+ | 100+ | 0+ | 0+ | 0+ | 0+ | 0+ |
| | 0+ | 100+ | 0+ | 0+ | 0+ | 0+ | 0+ |

4.1 15.8

T 75%0.3° – 0.6 t 10.0 t <4.1m> ±10° n 1 x OK

Fig. 4

14

[m] END >?<

[m]><[t] CODE>0005< t 201 00014 00.1(3)

| | 17.0 | 17.0 | 20.5 | 23.9 | 10.2 | 13.6 | 13.6 |
|---|---|---|---|---|---|---|---|
| 2.0 | 10.3 | 11.5 | 11.3 | | 14.7 | 14.2 | 13.5 |
| 2.5 | 10.0 | 11.5 | 11.3 | 7.9 | 15.0 | 14.4 | 13.7 |
| 3.0 | 9.8 | 11.6 | 11.1 | 7.6 | 15.4 | 14.5 | 13.8 |
| 3.5 | 9.6 | 11.8 | 11.0 | 7.4 | 15.9 | 14.6 | 14.1 |
| 4.0 | 9.4 | 11.9 | 10.9 | 7.2 | 16.8 | 14.6 | 14.3 |
| 4.5 | 9.3 | 12.1 | 10.8 | 6.9 | 18.2 | 14.7 | 14.6 |
| 5.0 | 9.1 | 12.1 | 10.7 | 6.7 | 19.1 | 14.8 | 14.8 |
| 6.0 | 8.2 | 12.2 | 10.6 | 6.4 | 17.7 | 15.1 | 15.3 |
| 7.0 | 8.0 | 12.1 | 10.5 | 6.1 | 13.4 | 13.8 | 13.8 |
| 8.0 | 7.8 → | 10.4 | 9.8 | 5.8 | | 11.0 | 11.0 |
| *n* | *3* | *3* | *3* | *2* | *5* | *4* | *4* |
| 8/16 | << | | | | | | >> |
| % | 0+ | 0- | 46- | 92- | 0+ | 0+ | 0+ |
| | 92- | 92+ | 92+ | 92+ | 0+ | 0+ | 0- |
| | 0+ | 0+ | 0+ | 0+ | 0- | 46- | 46+ |
| | 0+ | 0+ | 0+ | 0+ | 0+ | 0+ | 0+ |

T 75%0.3° | – | 0.6 t | 10.0 t <4.1m> | ±10° | n 1 x | OK

Fig. 7

CRANE, PARTICULARLY CRAWLER CRANE OR MOBILE CRANE

BACKGROUND OF THE INVENTION

The present invention relates to a crane, particularly a crawler crane or mobile crane, as well as to a monitoring and simulation means for a crane.

In general, known cranes, such as, crawler cranes or mobile cranes, are provided with a deployment planner.

Thus, for example, from DE 10 2005 059 768 A1, a crane is known which is provided with a crane monitoring device for monitoring the operational state of the crane, consisting of a calculation unit and an operation and display unit. Moreover, a deployment planner consisting substantially of an additional calculation unit having its own monitor output, is provided, works, on the one hand, as a device for planning the crane deployment, and, on the other hand, as a redundant crane monitoring unit in addition to the crane monitoring unit.

The deployment planning made possible with such a deployment planner enables the generation and display of bearing load tables in which the degrees of that are possible for the given configuration of the crane freedom are taken into account. Here, there is always a principal luffing movement, the design of which may be different depending on the type of operation. In the principal boom operation and in operation types with cylinder-adjustable or fixed accessory, the principal luffing movement is the boom luffing, whereas in case of operation with a movable accessory boom, for example, an accessory boom that is movable via cables, the principal luffing movement is the luffing of the accessory boom. The principal luffing movement is represented in table form in columns in the bearing load representation. Additional operating movements that are taken into account in the bearing load representation are represented in the hearing load representation in table form using additional columns.

These tables have been shown to be satisfactory in practice: however, it would be desirable to have available stored bearing load values that apply not only to exactly defined states corresponding to discrete radius steps. At present, for intermediate states, the currently admissible maximum bearing load is calculated and displayed for each case by the crane control. However, for other positions that differ from the current position of the crane, the crane operator receives no data on the maximum admissible bearing load.

From EP 1 444 162 B1 a crane having a deployment planner is also known, which comprises a graphic display which can display, in a work mode and in a planning mode, the work field of the crane under the given parameter settings, between a solid and a broken line, in a diagram with counterweight radius as the x-axis and load radius as the y-axis.

SUMMARY OF THE INVENTION

Therefore, the problem of the present invention is to further develop a crane of the type indicated in the introduction, particularly to the effect that said crane can display the current bearing load and/or the possible bearing loads, in particular the maximum possible hearing loads or crane movements, in a simple and understandable manner.

This problem is solved according to the invention by a crane having the characteristics herein. Accordingly, a crane is provided with at least one monitoring and simulation means, by means of which a state of the crane can be monitored and/or simulated, wherein the monitoring and simulation means comprise at least one input means and at least one output means, and wherein, by means of the monitoring and simulation means, the change in state, particularly the bearing, load curve of the crane, and particularly also the movement of the crane and/or of the boom of the crane, can be represented at any time, and/or a possible state and/or a possible change in state of the crane, particularly the bearing load curve of the crane, can be simulated and/or represented.

The simulation and/or representation of the change in state and preferably of the bearing load curve of the crane at any time relates particularly to the circumstance that this can occur taking into account several degrees of freedom, particularly taking into account, for example, both the telescoping movement and also the simultaneous luffing movement of the crane.

The crane can be particularly a crawler crane or mobile crane. Advantageously, it is possible to display, in a simple and understandable manner, current and/or possible bearing loads, particularly maximum possible bearing loads or crane movements. The representation is preferably a graphic representation which can be comprehended in a simple and intuitive manner. The comparatively time consuming evaluation of the bearing load tables can be omitted, and, instead, the crane driver or crane operator can, at a glance, perceive the current state or a possible state of the crane, and in this manner evaluate the current state, for example, with regard to the bearing load, and/or plan additional crane movements.

Moreover, it is possible to provide that the monitoring and simulation means comprises at least one calculation unit and/or can be or is connected to at least one calculation unit, wherein the parameters describing the current state of the crane can be evaluated by means of the calculation unit and/or wherein a possible state and/or a possible change in state of the crane can be simulated and/or calculated by means of the calculation unit.

Moreover, it is conceivable that the monitoring and simulation means presents at least one model generation means, wherein, by the interaction of the calculation unit and the model generation means, the change in state and/or the possible change in state can be calculated. For example, the change in state, which may be the current and/or a possible change in state, can be calculated approximately. In the broadest sense, this involves a model of the change in state. The change in state and/or the possible change in state can accordingly be modeled particularly by the interaction of the calculation unit and the model generation means, preferably as a model in the form of at least one mathematical function.

It is possible to provide that the change in state and/or the possible change in state can be represented as a graph or curve, particularly a function curve of the generated model, wherein the actual state of the crane and/or the possible actual state of the crane can be represented on the graph or on the curve, in particular in a manner with highlighting in comparison to the surroundings. The representation as a graph or curve allows a simple and intuitive perception at a glance, wherein advantageously not only the current state, but also states in the surroundings of the actual state can be perceived at a glance in a simple and intuitive manner by the operator. By highlighting the actual state on the graph or the curve, a simple and rapid orientation of the operator becomes possible.

Furthermore, it is conceivable that the change in state is a bearing load curve of the crane, particularly a curve representing the hearing load of the crane, wherein the bearing load curve is preferably represented graphically as a curve by means of the output means.

The actual state of the crane can be represented on the represented bearing load curve as a bold-print point or cross.

In addition, it is possible that the model representing the change in state and/or the possible change in state is a multidimensional, particularly at least two-dimensional, model on the basis of at least two influencing factors that influence the bearing load of the crane, wherein the influencing factors are particularly the luffing movement and the telescoping movement of the crane.

It is advantageously conceivable to provide for being able to include in the model, as additional influencing factors, besides the luffing movement and/or telescoping movement, the luffing of the accessory boom, a luffing of the derrick boom, a setting of the pulled derrick ballast, a change in the derrick ballast radius, a rotation of the upper carriage, a change in the spreading angle between the stay racks in case of Y guying, and the crane inclination or also the wind.

Moreover, it is possible to provide that the change in state is a bearing load curve of the crane, particularly a curve representing the bearing load of the crane, wherein the bearing load curve can preferably be represented graphically as a curve by means of the output means and/or wherein the bearing load is plotted on the y-axis or height axis and/or wherein the actual state of the crane can be represented on the represented hearing load curve as a bold-print point or cross, and/or that, by means of the monitoring and simulation means, the at least two-dimensional model can be represented in the form of superposed curves in a plane and/or in the form of a perspective representation, preferably by a perspective representation of a characteristic zone or relief.

Moreover, it is possible that the monitoring and simulation means comprises at least one monitor with at least one keypad as input means and with at least one display as output means, or that the monitoring and simulation means is designed as a monitor with at least one keypad as input means and with at least one display as output means.

It is possible to provide that the crane comprises at least two master switches which can be and/or are connected to the monitoring and simulation means, wherein at least one first master switch is provided, by means of which the luffing movement of the boom can be controlled directly and/or indirectly, and wherein at least one second master switch is provided, by means of which the telescoping movement can be controlled directly and/or indirectly, wherein preferably, on the basis of the entries via the master switch by means of the monitoring and simulation means, the change in state, particularly the bearing load curve of the crane, can be represented, and/or a possible state and/or possible change in state of the crane, particularly the bearing load curve of the crane, can be simulated and/or represented.

Moreover, it is conceivable that the master switch(es) can be operated in at least one first and at least one second mode, wherein, in the first mode, at least one crane element can be actuated, and wherein, in the second mode, by means of the master switch, entries can be made to the monitoring and simulation means, particularly using a TrackPoint and/or a PC mouse.

Moreover, the present invention relates to a monitoring and simulation means for a crane having the characteristics herein. Accordingly, a monitoring and simulation means for a crane, particularly for a crawler crane or mobile crane, is provided, which is designed with the monitoring and simulation characteristics herein.

BRIEF DESCRIPTION OF THE DRAWINGS

Additional details and advantages of the present invention are explained in greater detail below in reference to an embodiment example represented in the drawing.

The figures show:

FIG. 4: an additional view of the display of the monitor;

FIG. 7: an additional view of the display of the monitor;

DESCRIPTION OF THE PREFERRED EMBODIMENTS

Figure 1:
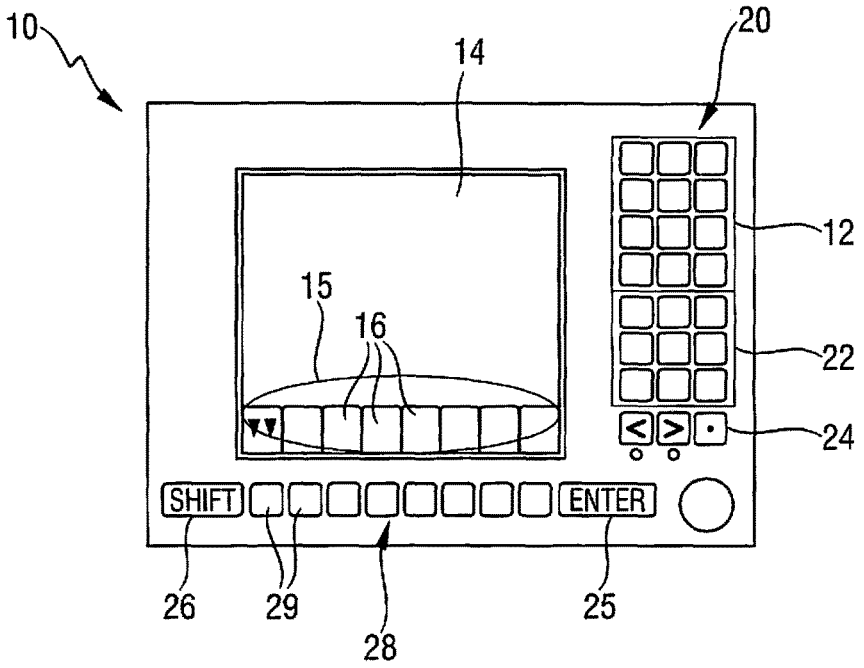
FIG. 1: a front view of the monitoring and simulation means.

FIG. 1 shows the monitoring and simulation means 10 for a crane which is not shown in further detail, wherein the monitoring and simulation means 10 are designed as monitoring and simulation monitor 10 or monitoring and simulation unit 10. Here, the monitor 10 has an input unit 12 and a display unit 14.

The monitor 10 contains at the same time also the calculation unit, by means of which the current state of the crane, particularly the current parameters relating, for example, to the maximum bearing load of the crane, can be evaluated. Moreover, by means of the calculation unit which is not shown in further detail, and of the model generation means stored therein, particularly by means of an appropriate program, a calculation model can be established, on the basis of which, for example, a possible change in bearing load or change in movement of the crane can be visualized and simulated. The monitor is thus designed like a "all-in-one computer."

The input unit 12 has several areas, wherein a first area is arranged in the upper right portion of the monitor 10, and comprises a numerical input block 20. Beneath the numerical block 20, a program key block 22 is provided, wherein subprograms can be called by means of the individual program keys. Beneath the program key block 22, special keys 24 are provided, wherein additional special keys 24, namely an additional input key 25 and an additional shift key 26, are arranged next to the function key line 28 located beneath the display 14. Here, the input key 25 is arranged on the right next to the function key line 28, and the shift key 26 is arranged on the left next to the function key line 28 with function keys 29.

By means of the display unit 14, the displays represented in FIGS. 3-15 and 18 can be represented, as described in detail below. In the bottom part of the display unit 14, which may be a display 14 or in an advantageous embodiment a touch screen 14, a display bar 15 or display line 15 consisting of several fields 16 is provided, in which the respective assignment as well the activation of the function keys 29, which depend on the selected program, is displayed.

For the operation of the crane, at least one program, which can comprise or be connected to the model generation means, is provided on the monitor 10. The program here has at least two essential program parts or operating modes in which it can be operated. Thus, on the one hand, as a first operating mode, a crane monitoring is provided, with a representation of the actual movements of the crane, and, on the other hand, as a second operating mode, a crane simulation, with virtual crane movements and the display thereof, and identical input units are provided.

The crane driver or crane operator can select freely between said two operating modes. In the "crane monitoring" mode, the crane with its movable crane elements is operated in the known manner using the input units. The input units, for example, the master switch(es) or the keys of the input unit 12 on the monitor 10 select the appropriate actuators in each case. The graphic bearing load representation described below can occur in the two-display areas, namely the "crane monitoring" and "crane simulation" areas.

In the "crane simulation" mode, the display in the display area 14 occurs very close to the display in the "crane monitoring" mode which is known to the crane driver or crane operator. The positions where the information contents are displayed, just like the symbols that are used, are intuitively known to the crane driver from the "crane monitoring" mode. Thus, he can immediately use the "crane simulation" mode and readily obtain the relevant information. In particular, it is no longer necessary to laboriously find the needed value from a multitude of values in table form. In both operating modes, the same information is always available, so that both program parts, after switching, immediately use the display that corresponds to the actual situation.

For example, it is possible to provide that the crane driver or crane operator switches from "crane monitoring" to "crane simulation." The "crane simulation" immediately displays the current state "$Z_{actual}$." In the next step, the additional steps can be planned, and in a simulated manner the crane can be moved into new positions in the "crane simulation" mode. Then, one can switch back to "crane monitoring." The display 14 in the "crane monitoring" mode immediately shows the actually existing state "$Z_{actual}$" again.

The use of the two program parts, namely "crane monitoring" and "crane simulation," occurs via the same input units 20, 22, 24, 25, 26, 28, 29 of the input unit 12. The entries via the input unit 12 here also have substantially the same effects on the display area 14 of the monitor 10. In the "crane monitoring" mode, the corresponding actuator of the crane element to be moved is at first still actuated. However, this is of course not the case in the "crane simulation" mode.

Moreover, it is possible to provide that the actual crane movements are controlled according to a pattern from existing records.

For safety reasons, the movement is of course not carried out completely automatically, but only for as long as and as rapidly as the master switch is deflected. If the master switch, after the stop, is again actuated in the provided manner, then the planned movement continues to be performed.

The actual movements obviously also continue to be monitored by the crane control with its load moment limitation, namely independently, and thus redundantly, by the monitor 10 which indeed functions not only as simulation means but also as monitoring means.

Figure 2:
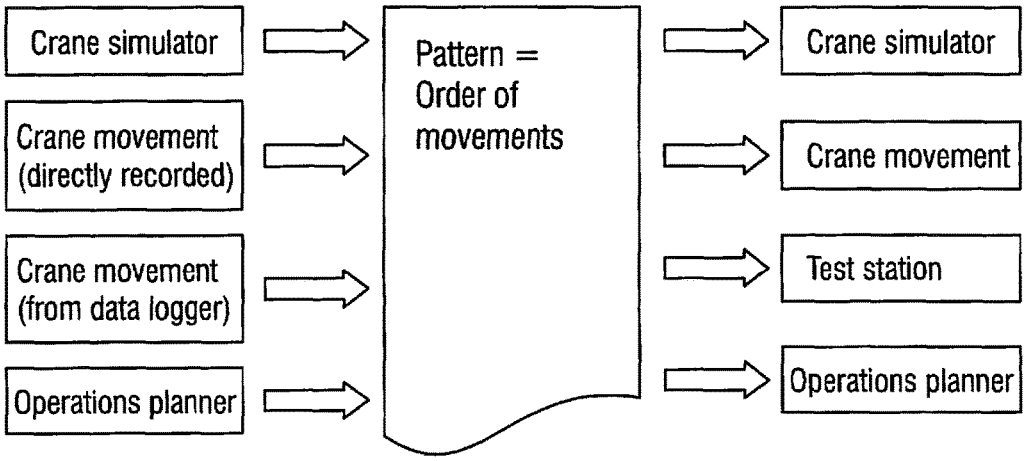
FIG. 2: a diagrammatic representation of the pattern generation.

In addition, the movements of the crane can also be run virtually on the crane simulator. Said patterns can also be run for the tests in a test facility, in which individual crane subunits are to be tested without the interaction of several components. As shown in FIG. 2, a corresponding pattern, that is a series of movements, can be generated by means of the crane simulator, a crane movement carried out in a targeted manner, a crane movement read from a data logger, or a movement simulated in the deployment planner. Said pattern can then be used in the crane simulator, for a crane movement, in the test facility, or in the deployment planner.

Said pattern can be filled from virtual movements of crane movements that have been taken up in a targeted manner and actually executed in the crane simulator, or from the data logger already present on in the crane, that is from a process-controlled storage unit of the crane. In this manner, as the final effect, a very good model of the crane movement, or in any case a model with sufficient precision, can be generated.

The graphic hearing load representation, which can be generated and reproduced with the monitor 10, can also be used on a PC when planning a deployment. It is particularly advantageous here that, for example, any existing planning data can be taken over accordingly, in particular it can be played from the PC on the monitor 10, and it is possible advantageously to work in the usual program environment. Thus, no conceptual readjustment is needed.

The operating mode, that is the "crane monitoring" or "crane simulation" mode, can be selected freely, independently of the operating mode in which the system happens to be.

Moreover, it is possible that the crane driver or crane operator can at all times lake over the operation via the master switches that are usually used in crane operation. Moreover, the symbols known from the "crane monitoring" operating mock or program part are also used in the "crane simulation" mode. This makes it easier for the operator to rapidly become familiar with the two operating mocks.

If the operator needs, in addition to the input possibilities via the input unit 12, an additional input means similar to a PC mouse, then this function is applied similarly to the "TrackPoint" in laptops to the master switch, and it is possible, by pushing a button, to switch the function of the master switch from normal operation to "TrackPoint" function. In this operating mode, the master switch thus functions as an additional input means for the monitor 10.

The displays represented in FIGS. 3-15 relate to bearing loads and the associated curve representations. The curves shown in FIGS. 3-15 and corresponding explanations are given as an example for the "boom luffing" crane movement.

Besides this degree of freedom or this performable movement possibility, a crane, depending on the crane configuration, also allows for additional degrees of freedom. Such additional, possible degrees of freedom can comprise, for example, the telescoping movement, the luffing of the accessory boom, a luffing of the derrick boom, a setting of the pulled derrick ballast, a change in the derrick ballast radius, a rotation of the upper carriage, a change in the spreading angle between the stay racks in case of Y guying, and the crane inclination or also the wind. With regard to the setting of the pulled derrick ballast, it can concern, for example, the transmission of the force via traction means from the derrick ballast to the upper carriage. As a rule, this force is smaller than the weight of the total derrick ballast.

All the curve representations have in common that all the degrees of freedom except for one are kept constant or fixed. This one, variable, degree of freedom is usually represented here on the x-axis. The y-axis represents the bearing load. In contrast to the representation in table form, there are many principal movements in the curve representation. The current principal movement is the movement represented in the graph along the x-axis. In this manner, it is possible to use different curves to graphically represent bearing loads versus crane movements, for which, for example, no data material at all in table form exists to date.

Besides the curve representation described below, concerning the "boom luffing" movement, additional curve representations can thus also be used, which, however, will be discussed only superficially below.

The embodiments represented in FIGS. 3-15 relate to a crane configuration with the degrees of freedom "boom luffing" and "telescoping." The curves represented here relate to the boom luffing; accordingly, the remaining degrees of freedom, here "telescoping," are kept constant. The crane is thus considered in the two limiting extension states or a telescopic boom, wherein the first extension state is an unbolted state with 0% extended boom (telescopic extension state 1, T 0+/0–/0+/0+, and the second extension state is also an unbolted state with 92% extended telescopic boom (telescopic extension state 2, T 0+/92–/0+/0+). In the designation of the telescopic boom states, for example, telescopic extension state 1, T 0+/0–/0+/0+, a "+" is used as a symbol for the bolted state, and a "–" for the unbolted state.

Moreover, intermediate extension states can be provided, which are also each unbolted, wherein one corresponds to an extension state with 30% extended boom (telescopic extension state 3. T 0+/+–/0+/0+, and an additional extension state corresponds to a 60% extended boom (telescopic extension state 4, T 0+/60–/0+/0+.

Figure 3:
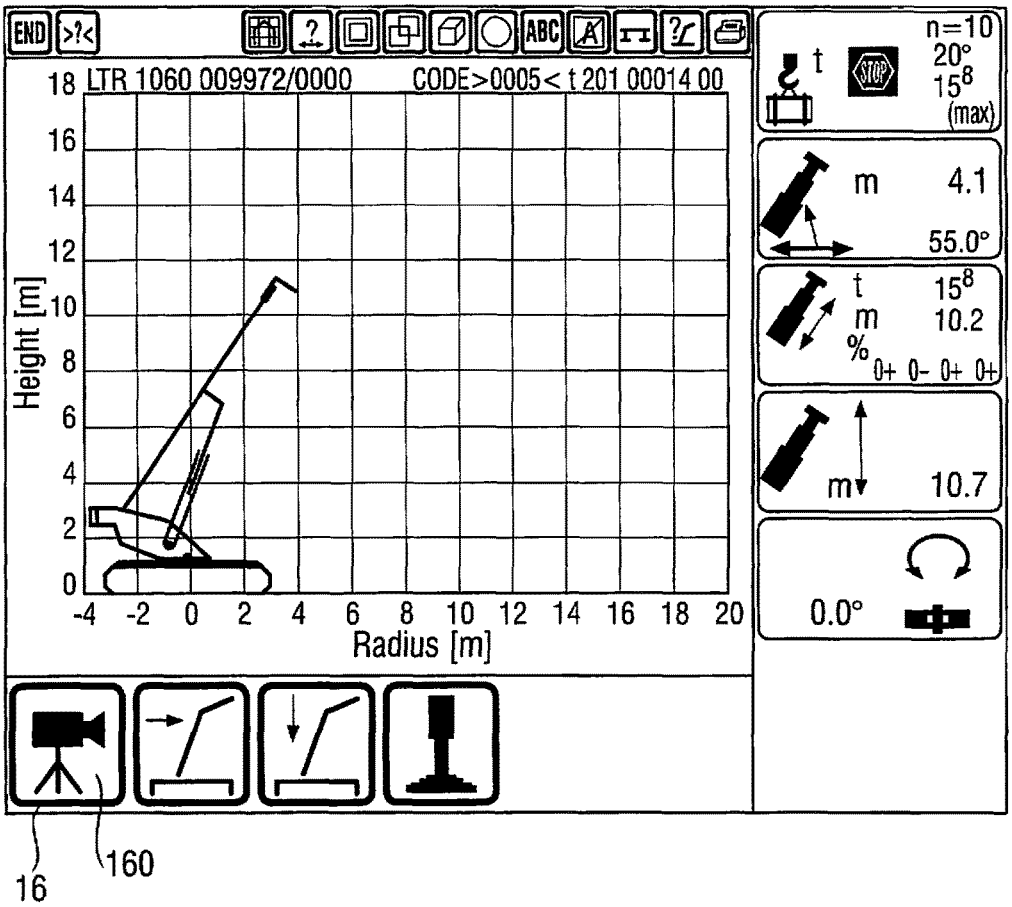
FIG. 3: a view of the display of the monitor.

FIG. 3 shows a possible representation which can be represented by means of the display area 14 of the monitor 10. Here, in the diagram, the crane is represented diagrammatically in a side view, namely in the telescopic extension state 1 with unbolted boom and 0% extension state of the boom. The principal boom angle is 55°, and the outreach 4.1 m. As the operator can see in the display 14 in the upper right portion of the display area, the bearing load of the crane in said unbolted state is 15.8 t. The bold-print frame around the selection button 16 represents the selected state, here with button 160 the selection "camera view."

FIG. 4 shows the associated bearing load table (or an excerpt thereof) of the crane for the crane configuration shown in FIG. 3. It contains the column which is marked in bold-print with the telescope length 10.2, and which has the bearing loads for the above telescopic extension state. Here, the outreach of 4.1 m according to FIG. 3 is not listed directly in the bearing load column. However, the corresponding associated bearing load value is determined by means of the calculation unit by interpolation from the adjacent outreaches 4.0 m and 4.5 m. Consequently, one gets the calculated value 15.8 t for the bearing load of the crane.

Figure 5:
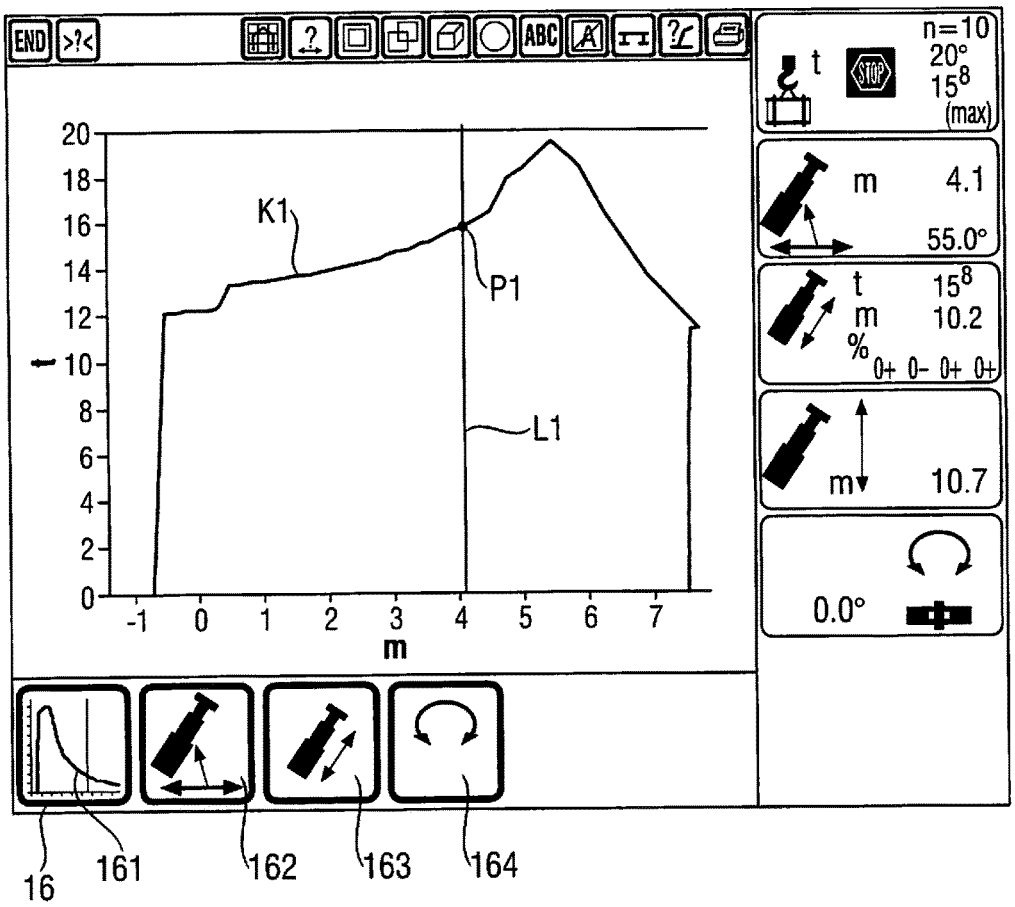
FIG. 5: an additional view of the display of the monitor.

By switching, the table shown in FIG. 4 can be displayed graphically by means of a diagram in addition to the associated bearing load curve K1 as a function of the outreach (see FIG. 5). In said curve K1, as explained above, the telescopic extension state 1 (T 0+/0–/0+/0+) of the telescopic boom is kept fixed, and the boom can be luffed. On the x-axis, not only the boom angle, but also the associated outreach in meter is displayed.

The vertical line L1 above the point P1, which is preferably colored red, shows the current state in relation to the outreach, that is the current state or actual state. By highlighting the point P1 with respect to the surroundings, the actual state can be perceived in a simple, intuitive, and reliable manner at a glance.

If according to FIG. 3, the movement in the crane simulator is performed, then it is possible, during the test run, to take watch out for a stop of the (additionally present) load moment limitation. The crane driver sees the result "STOP" only when the limit value has been reached. This is consequently a one-time display possibility.

By comparison, the solution shown in FIG. 5 makes it possible to run through the planned crane movement in the crane simulator, and to obtain in the process both a preview and also a retrospective view. The display shows how the bearing load would change if the crane were moved in this direction. Thus, it is possible to carry out the planning more rapidly, and also to find the actually feasible crane movement more rapidly.

The bold-print frame around the selection button 16 represents the selected state, here, using button 161 the selection "graphic representation" with graphic representation of the bearing load curve K1, and using button 162, the "boom luffing" movement. Other selection possibilities would be, for example, the "telescoping" movement, using button 163, and the "rotation of the upper carriage" movement, using button 164. Advantageously, the scales adapt automatically to the representable range. As a result the operator or the crane driver receives the maximum possible magnification level. As directly evident from a comparison of FIG. 4 and FIG. 5, it is now possible particularly advantageously to perceive at a glance at which outreach the maximum bearing load of the crane is reached, and what the actual situation of the crane at the selected outreach is.

Figure 6:
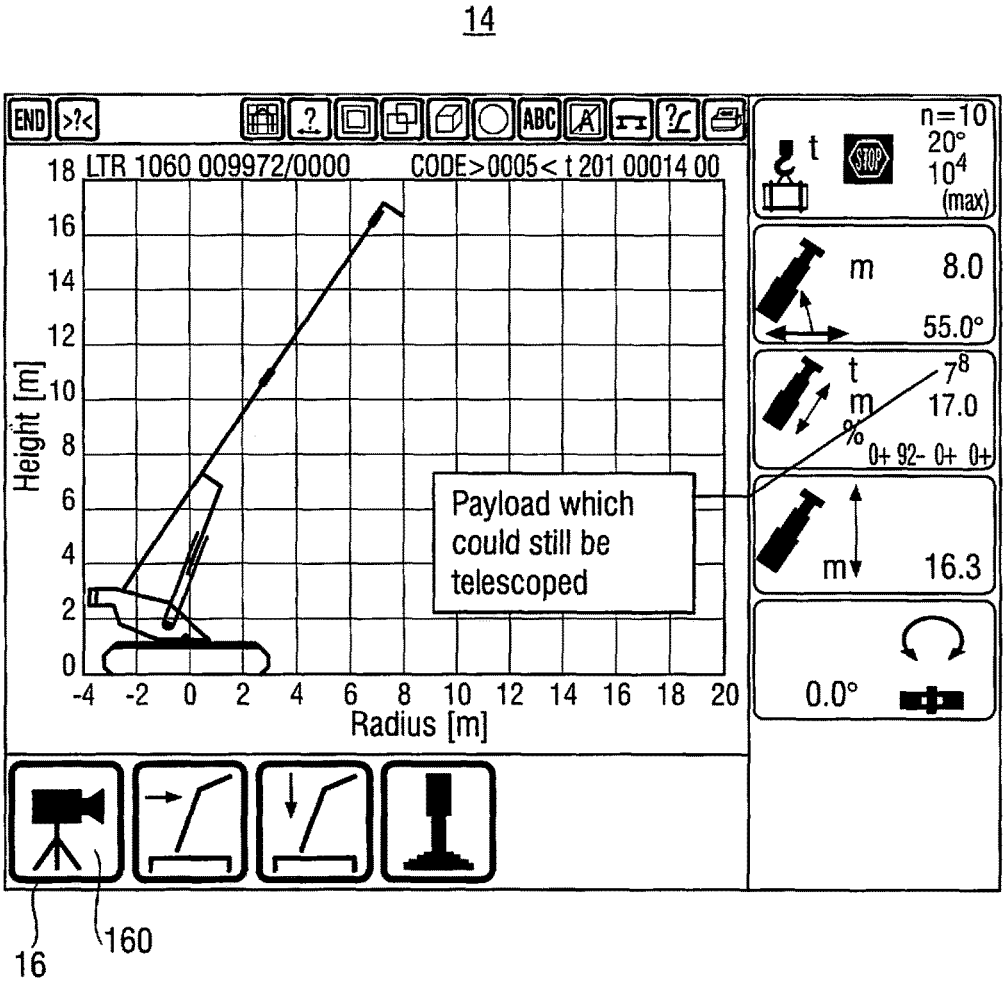
FIG. 6: an additional view of the display of the monitor.

FIG. 6 shows a representation of the display area 14 with diagrammatic representation of the crane in the side view in telescopic extension state 2 (T 0+/92–/0+/0+), with the principal boom angle 55° and the outreach 8.0 m. As represented in the upper right area of the display 14, the maximum hearing load of the crane in this unbolted state is 10.4 t. As in state 1, the bearing load table (see FIG. 7) and the corresponding graphic bearing load curve K2 (see FIG. 8) relating to the "boom luffing" from the crane simulation are added, or they can be called, here as well. Here too, analogously to FIG. 5, the vertical line L2 shows the current state with regard to the outreach, by means of the point P2 which is preferably colored red.

Figure 8:
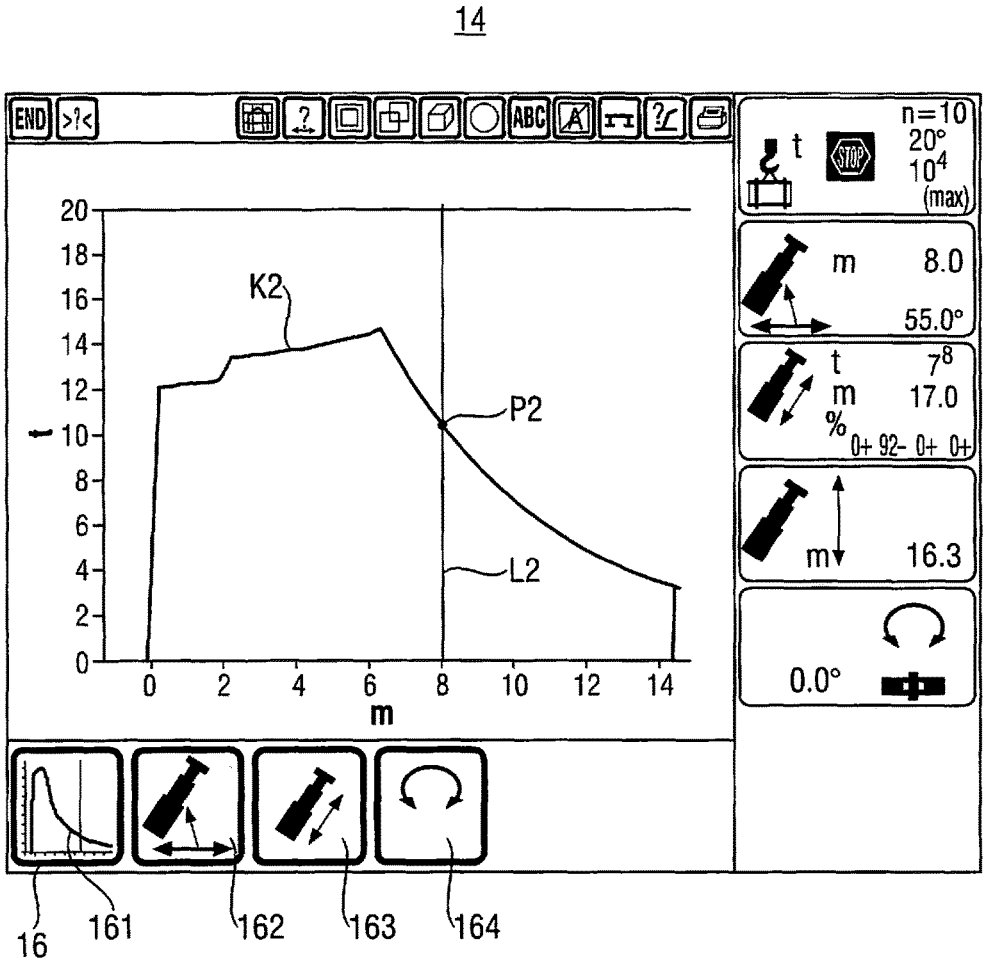
FIG. 8: an additional view of the display of the monitor.

This is in relation to the corresponding views according to FIG. 4 and FIG. 5, except here, in FIGS. 7 and 8, for the telescopic extension state 2 (T 0+/92–/0+/0+) shown in FIG. 6.

Figure 9:
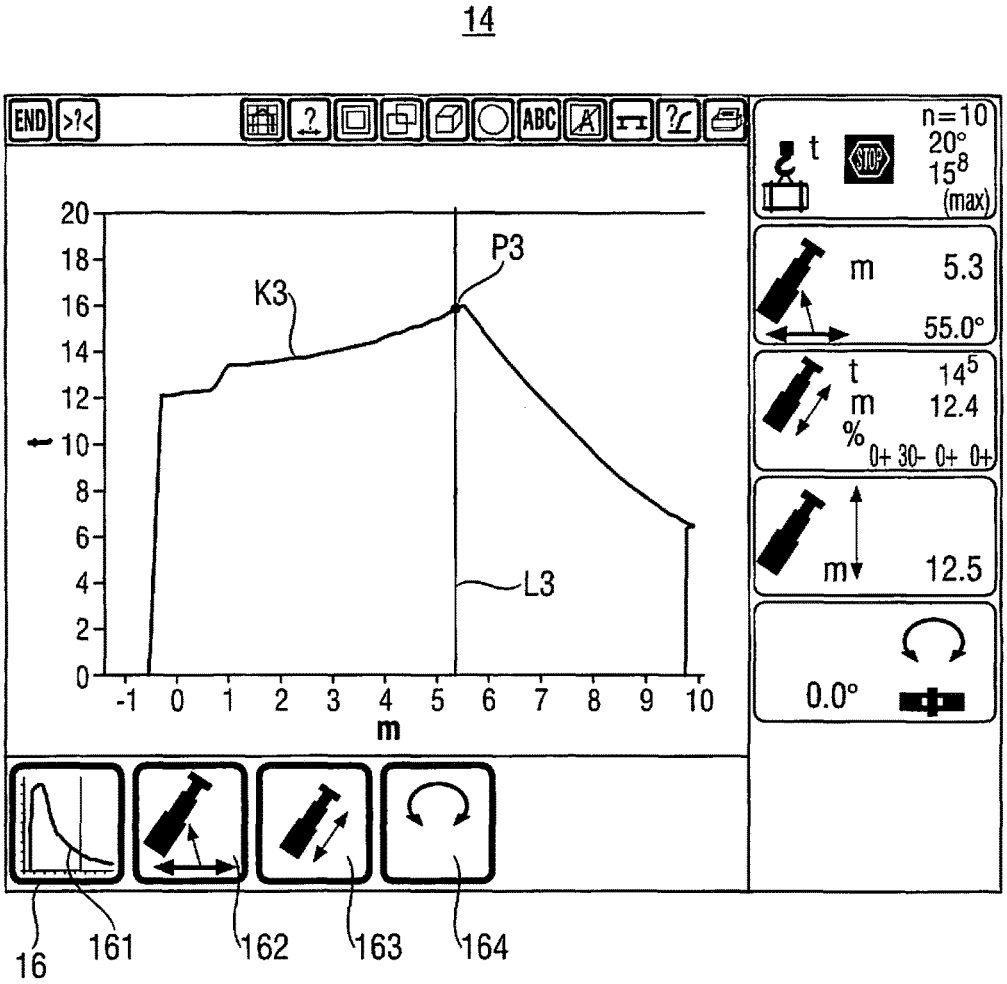
FIG. 9: an additional view of the display of the monitor.
Figure 10:
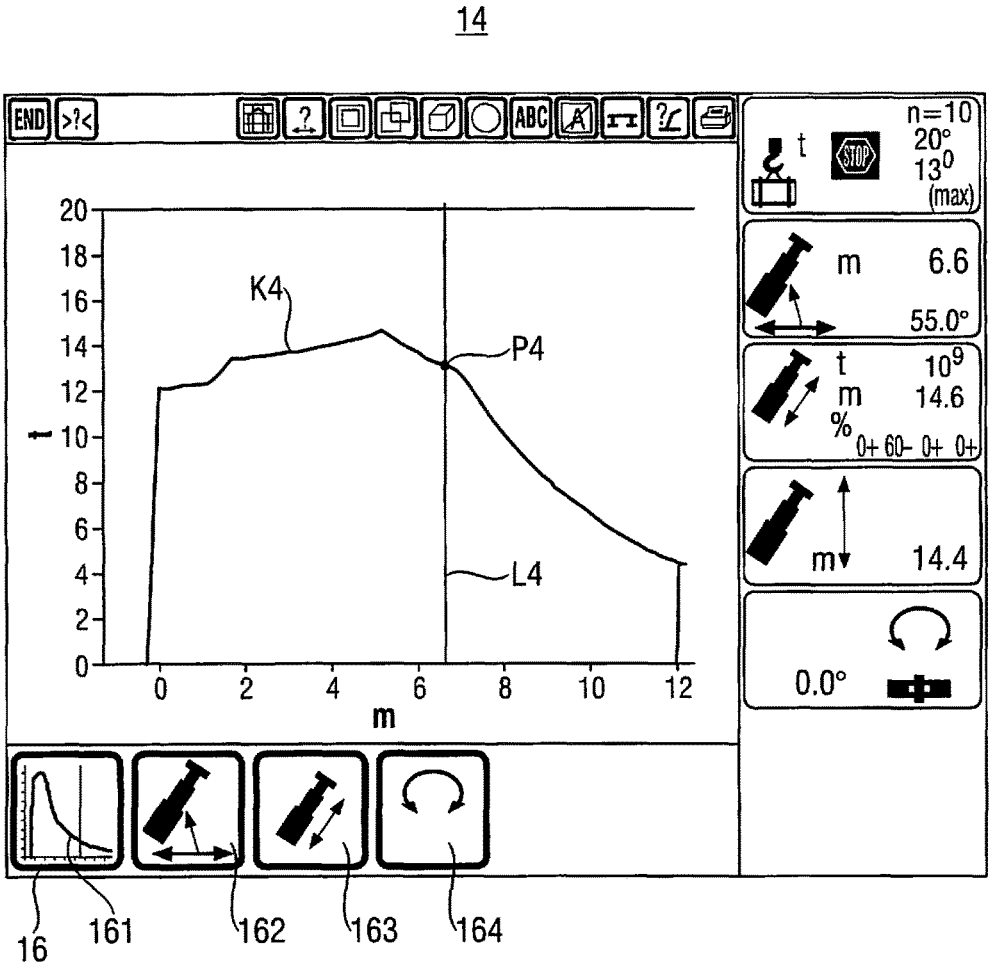
FIG. 10: an additional view of the display of the monitor.

To get from state 1 to state 2, the crane driver must extend the telescope 2 from 0% to 92%. In the process, during the extension process, a load may also be suspended on the hook. However, for said different extension states, from 0% to 92%, there are no explicit data in the bearing load table. The bearing load determination consequently must base itself on the limiting columns, and determine the respective bearing load value. This occurs advantageously by means of the calculation unit of the monitor 10. Via the display area 14 of the monitor 10, it is possible to display, for example, the extension states of the telescope 2 which are located between the extension states 30% (state 3) and 60% (state 4), wherein corresponding representations of the curves K2 and K4 are shown in FIG. 9 and FIG. 10.

Here too, analogously to FIGS. 5 and 8, the vertical line L3 or L4 shows the current state with regard to the outreach by means of the point P3 or P4 which is preferably colored in red.

It is also conceivable to superpose the curves shown in FIG. 5, FIG. 8. FIG. 9 and FIG. 10 (see FIG. 17). Because, in principle, the crane problem is that, with increasing number of degrees of freedom, the bearing load behavior of the crane is increasingly difficult to predict. Accordingly, the bearing load behavior is here increasingly more difficult to obtain from a table-format presentation.

For example, if the crane had only one degree of freedom, for example, "fixed outreach length" and "boom can only be luffed," then the bearing load behavior would still be relatively easy to predict or read from a table.

In a crane with several degrees of freedom, for example, with a boom which can be telescoped under a load or also simultaneously luffed, etc. it is helpful, however, if the bearing loads can be represented spatially. Accordingly, it is also advantageous to represent the corresponding bearing load curves spatially.

Figure 11:
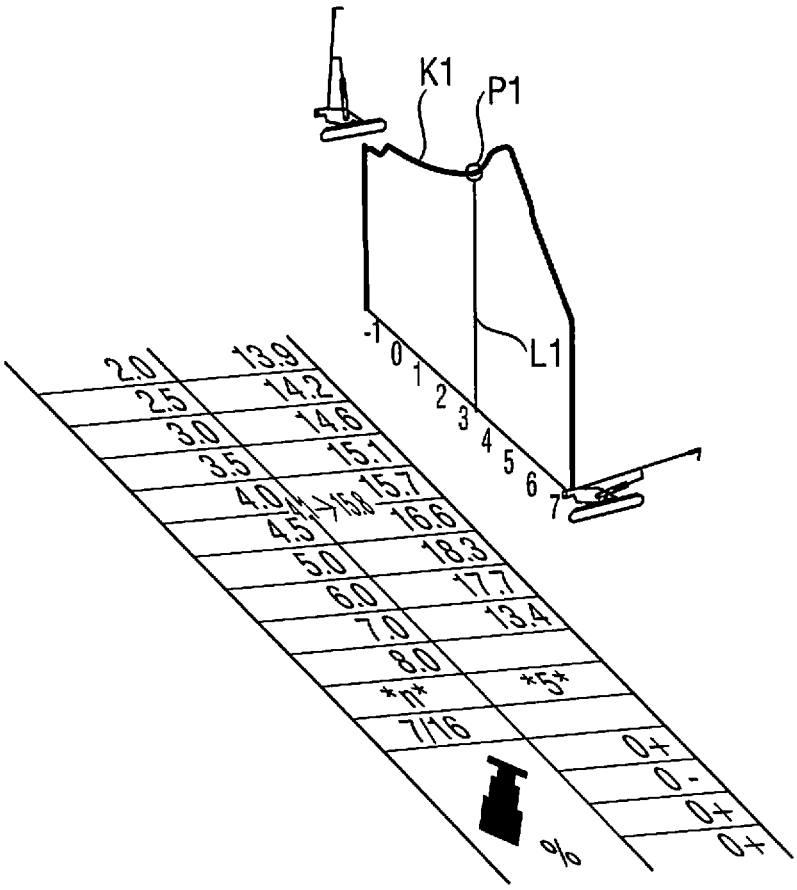
FIG. 11: a view of a perspective representation of a bearing load curve.
Figure 12:
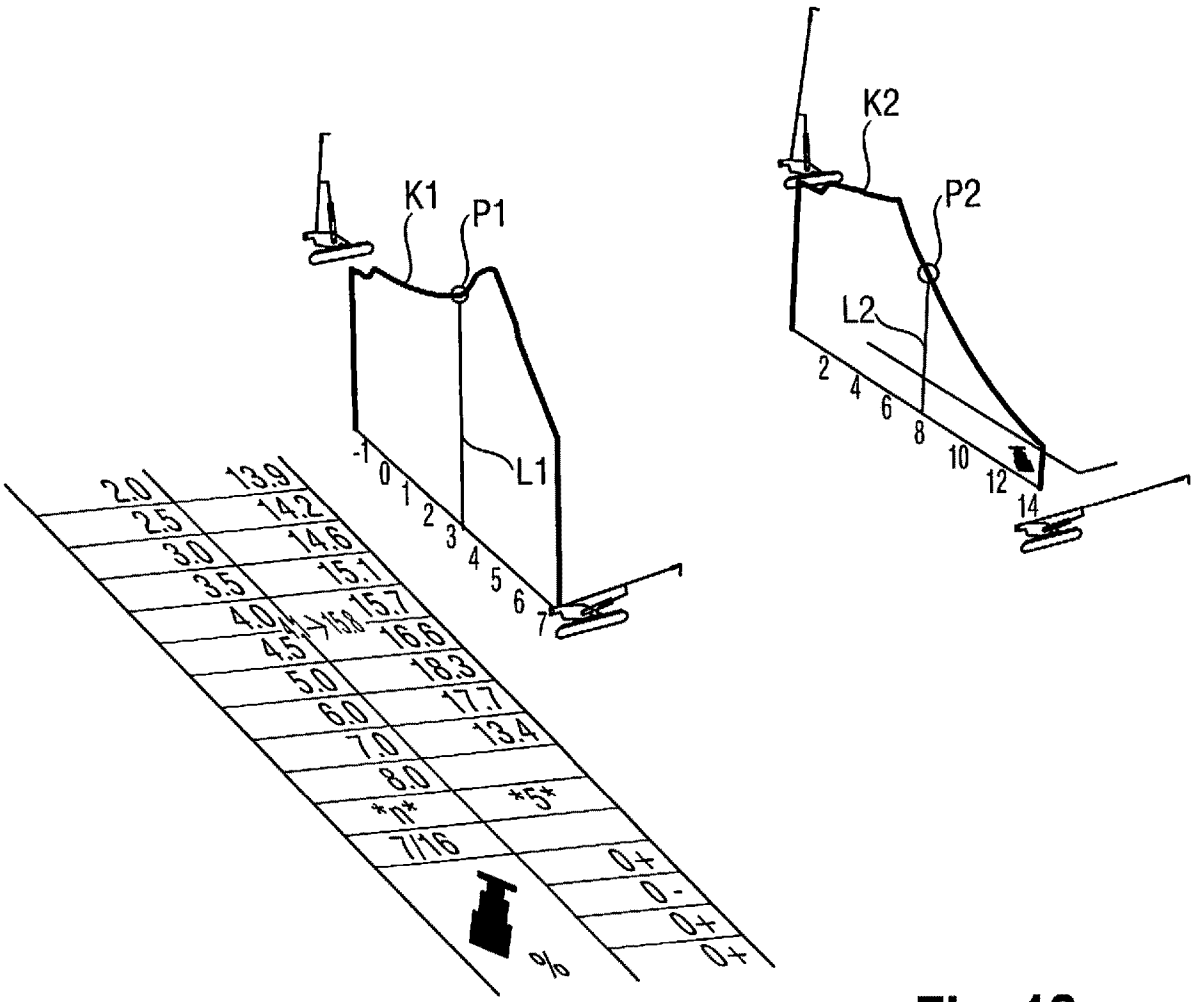
FIG. 12: a view of a perspective representation of a bearing load curve.
Figure 13:
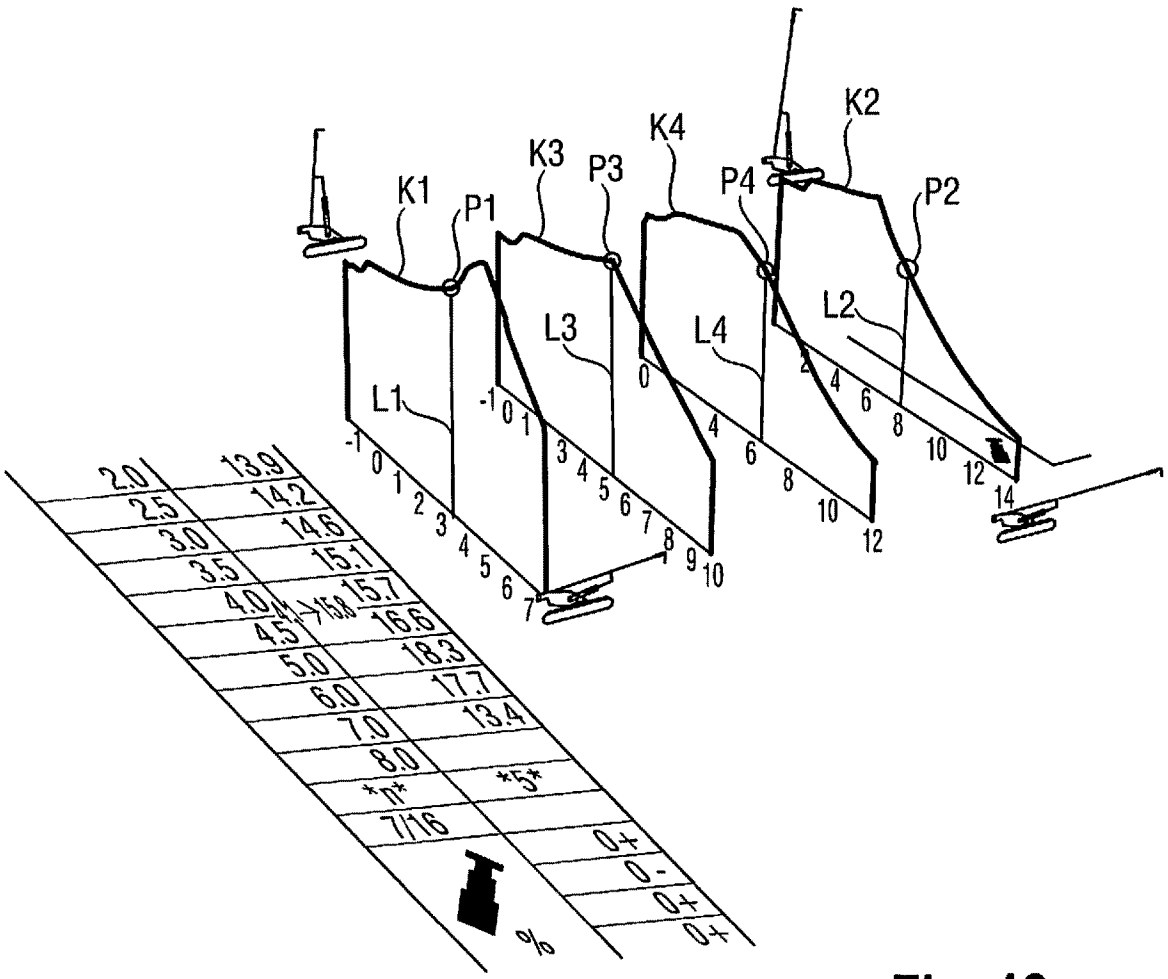
FIG. 13: an additional view of a perspective representation of bearing load curves.
Figure 14:
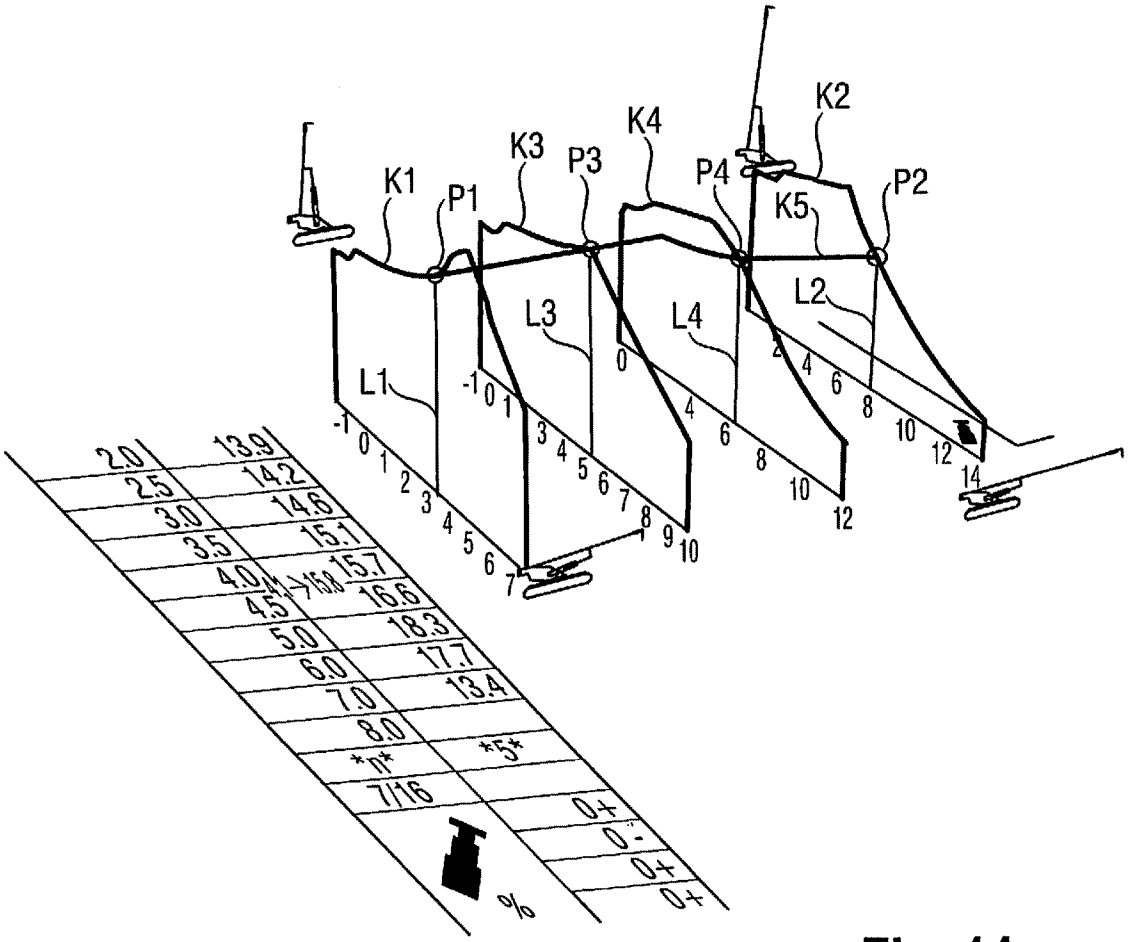
FIG. 14: an additional view of a perspective representation of bearing load curves.

FIG. 11 shows the bearing load curve K1 of the state 1 (sec FIG. 5) in a perspective view in space. Beneath, the bearing load table used to date can be seen. In FIG. 12, the bearing load curve K2 according to state 2 (see FIG. 8) is added. In FIG. 13, the two bearing load curves K3 and K4 of state 3 (see FIGS. 9 and 10) are added. In an advantageous embodiment, said perspective views can also be represented by means of the display 14.

One can clearly see that one direction in space represents a change in the boom angle, whereas the other direction in space represents a change due to telescoping. Height represents the bearing load.

For telescoping with a load under a fixed boom angle, a curve also exists, namely through the points P1, P2, P3 and P4. Assuming a starting position as described under state 1, and a target situation as described under state 2, the curve can be represented as follows by means of appropriate connections of the curves represented in the curves according to FIGS. 11-14:

Thus, a bearing load curve K5 is obtained for the telescoping in a fixed luffing angle. Connecting all the curve points of the four curves K1, K2, K3 and K4 adjacent in space would result in a characteristic zone or a relief which describes the bearing load behavior.

An additional representation possibility consists in allowing two or more degrees of freedom to contribute to the calculation which can be carried out by means of the calculation unit and the model generation means. For example, the crane driver or crane conductor can here control the movements of the crane via the master switch. In the "crane operation" mode, the crane is actually operated, whereas in the "crane simulation" mode, the crane moves only on the display, i.e., the crane movement is only simulated and represented via the display means 14 or the display 14 of the monitoring and simulation monitor 10. In both cases, the above-described point, for example, the point P1, continues to move on the bearing load curve K1 in accordance with the movement. The bearing load curves are here calculated and displayed continuously with the current crane movement.

Moreover, at least two master switches are present for controlling the crane movements. On each master switch, another function assignment can be provided. For example, telescoping can be carried out with the first master switch, and the boom can be luffed with the second master switch. It is also conceivable that a master switch receives two functions or function assignments which are associated with the movement directions (front/back or left/right) of the master switch. Thus the "telescoping" crane movement can be on the forward and backward movement of the master switch, and the crane movement "principal boom luffing" on the left/right movement of the principal switch. Moving the master switch exactly in the 45° angle towards the front right would thus represent a simultaneous movement with identical movement components of the movement consisting of "luffing" and "telescoping."

A bearing load curve of such a movement can also be calculated and represented by means of the monitoring and simulation monitor 10 or its calculation unit with the model generation means. Here, in the representation on the display 14, for example, on the x-axis, the outreach resulting from the crane movement comprising 50% "telescoping" and 50% "boom luffing" would result, and the associated maximum bearing load can be represented on the y-axis.

Figure 15:
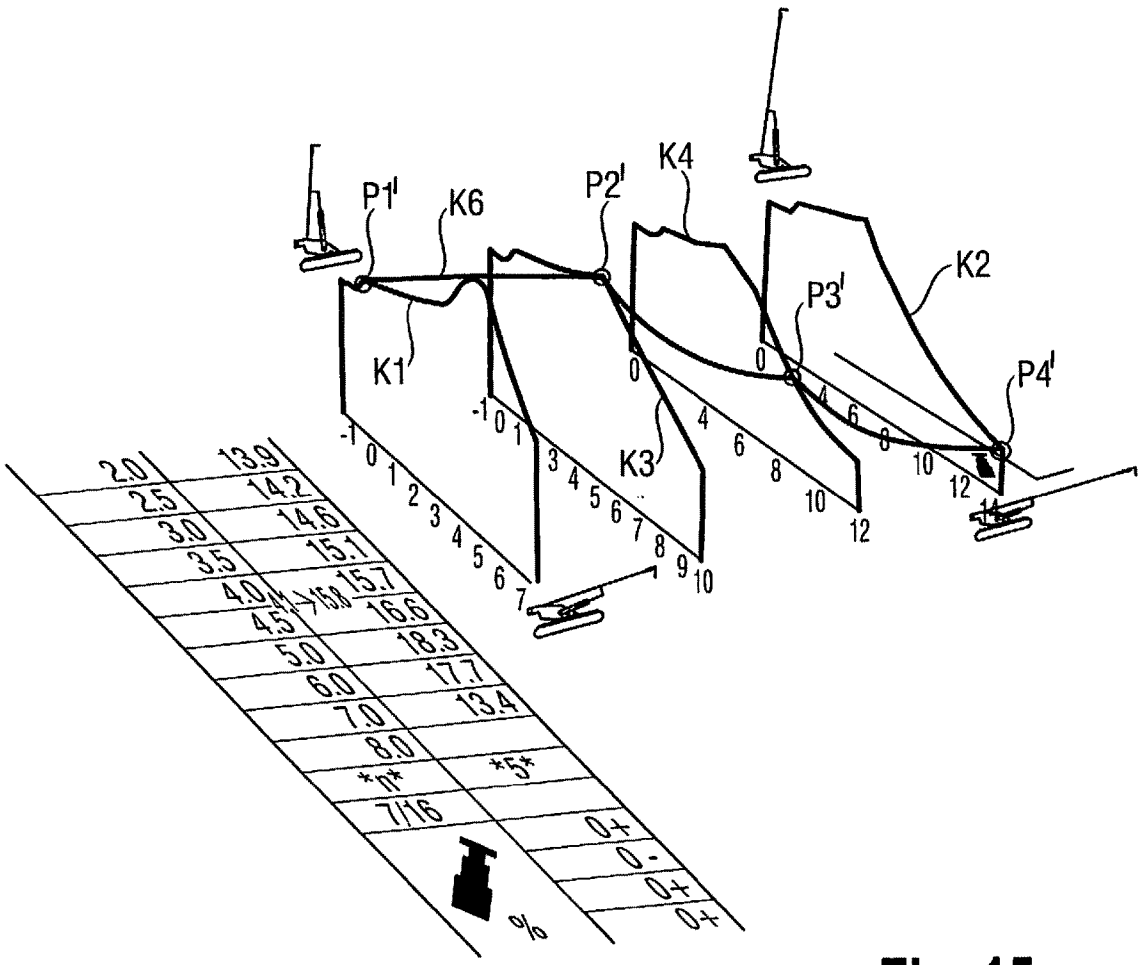
FIG. 15: an additional view of a perspective representation of bearing load curves.

According to this principle, additional degrees of freedom are advantageously included in the calculation and modeling of the bearing load curve. In a two-dimensional curve representation on the display 14, the resulting outreach which is changed by the current movement form of the crane, i.e., the resulting outreach as a function of the included degrees of freedom or influencing factors, is accordingly also plotted on the x-axis, and the associated bearing load on the y-axis. An example is shown in FIG. 15, wherein the "upward/downward luffing" and "telescoping" movements are recorded on the curve plot. The curve K6 thus shows the change in bearing load as a function of the outreach which changes due to a simultaneous movement of the principal boom by "luffing" and "telescoping."

It is evident that the crane movement can change at all times. In that case, the calculation unit has in particular the following tasks:

Thus, the current outreach must be calculated on the basis of the moved crane elements. Moreover, the currently admissible bearing load and the bearing load associated with the respective outreach have to be calculated, to allow the obtention of a curve or function of the y=f(x) type, and thus a model. If the type of the composite movements comprising the different individual movements is constant, then the curve y=f(x) does not need to be recalculated. If the type of movement is changed, however, for example, by a changed movement component of the "telescoping" or "luffing" movement, for example, more "telescoping" and less "luffing," then only the curve y=f(x) is calculated, and a new model established.

Figure 16:
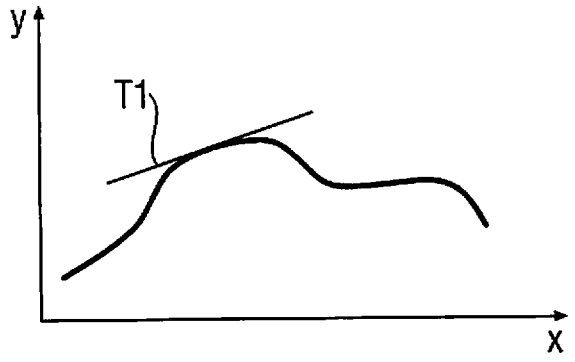
FIG. 16: a simplified representation of a graph of a composite crane movement.

FIG. 16 shows a simplified representation of a graph of a composite crane movement. Each bearing load curve can be considered a cross section through the repeatedly curved bearing load plane with various support places, which has been described as an example in connection with FIGS. 14 and 15, for example, in FIG. 14 by the points P1, P2, P3 and P4, and in FIG. 15 by the points P1', P2'. P3' and P4'.

If the components of the composite movement change, the graph represented in FIG. 16 may result. The "luffing" movement component is plotted along the x-axis, and the "telescoping" movement component along the y-axis. In all cases, the graph shown is the one that would be associated with a movement if the current movement were continued uniformly. This could be considered the tangent T1 bearing the reference T1 in FIG. 16. In case of a change in movement, this tangent always needs to be recalculated.

Figure 17:
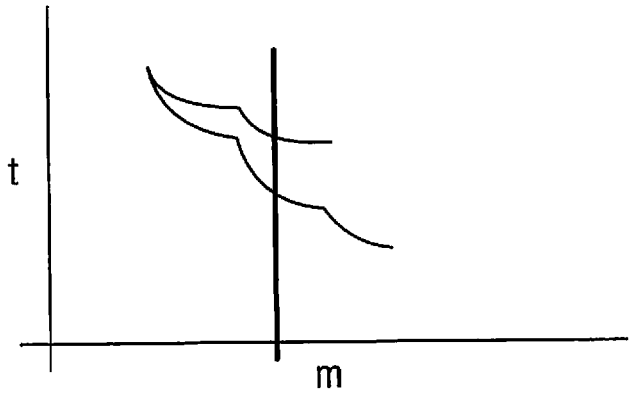
FIG. 17: a diagram for the bearing load as a function of the outreach.
Figure 18:
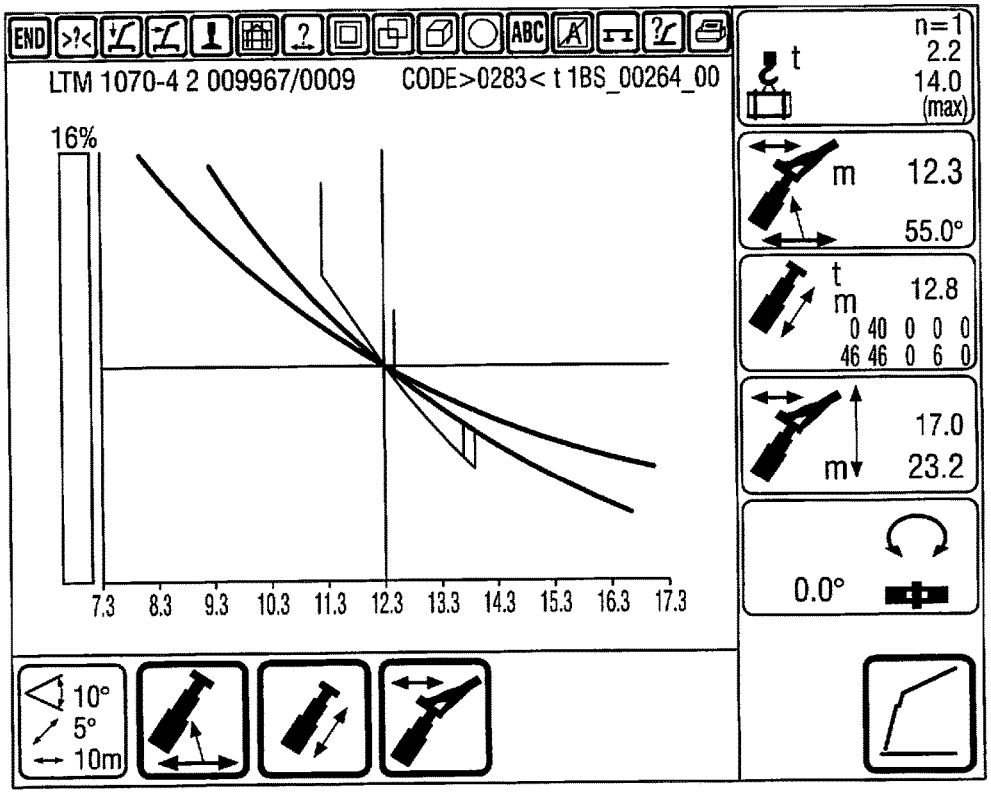
FIG. 18: a view of the display with several superposed bearing load curves.

FIG. 17 shows the diagram for the bearing load as a function of the outreach. The crane driver has extended the telescope to the actual state (0+/0+/46−/46+). He would like to brine the boom back to the target state (46−/46+/46+/0+). He selects this target state, and issues the request to reach the target state. The telematics then processes this request as if it were a pattern according to FIG. 2 to be processed. Specifically, the telescoping cylinder for this purpose uses first a telescopic shot 3, then the telescopic shot 4. In the process, the red point P1 (not shown in FIG. 17) moves on the upper line to the left, analogously to the description so far. The maximum admissible bearing load increases. Then, the telescoping cylinder starts to extend the telescopic shots 3, 2 and 1 sequentially, and the maximum admissible bearing load decreases again. From this example, it is also evident that a vertical line alone is not sufficient to represent the current bearing load. The above described "red point" P1 is needed.

Besides a perspective representation as shown in FIGS. 11-15, it is also conceivable to show an overlap of the curves in a single diagram. Thus, in FIG. 18, several curves for different movements in one plane are represented, and scaled in such a manner that they mutually intersect in the current actual state. In this manner, the crane driver can find out which movement, the can use to reach the desired position most advantageously.

Furthermore, it is possible to provide that an automatic switching of the curve occurs depending on the movement that has just been performed. In this manner, in the case of a luffing movement, the luffing curve can be displayed automatically, and analogously, in the case of a telescoping movement, the associated telescoping curve can be shown.

The invention claimed is:

1. A crane, particularly crawler crane or mobile crane, the crane includes a computer that is configured with at least one monitoring and simulation mode, by which a state of the crane can be monitored and simulated, wherein the monitoring and simulation mode comprise at least one input unit and at least one output unit, and a switching unit to switch an operation mode of the crane between the monitoring mode and the simulation mode based on a switching input of a crane operator, the monitoring mode represents at any time a first operating mode of the change in state of a bearing load curve of the crane, the movement of the crane and/or a boom of the crane, the simulation mode represents and simulates a second operating mode of a possible state and a possible change in state of the crane and/or boom, the bearing load curve of the crane and/or the movement of the crane and/or boom, wherein upon the switching input from the crane operator to enter the monitoring mode the first operating mode monitors the crane based on actual movement of the crane based on crane control inputs from the crane operator and upon the switching input from the crane operator to enter the simulation mode the second operating mode simulates virtual crane movement based upon crane control inputs from the crane operator, the monitoring and simulation modes include at least one model generation mode that displays a multidimensional model on the output unit by an interaction of a calculation unit and the model generation unit, and the multidimensional model generated by the model generation unit represents the change in state and/or the possible change in state of at least a portion of the crane, wherein the change in state represents an actual movement of at least a portion of the crane and a possible change in state represents a virtual movement of at least a portion of the crane, wherein the multidimensional model is generated based on: a first bearing load curve having two dimensions, wherein the first dimension of the first bearing load curve is associated with varying luffing of the crane while holding constant telescoping of the crane at a first value, and the second dimension of the first bearing load curve is associated with a maximum bearing load of the crane, and a second bearing load curve having two dimensions, wherein the first dimension of the second bearing load curve is associated with varying telescoping of the crane while holding constant luffing of the crane at a second value, and the second dimension of the second bearing load curve is associated with the maximum bearing load of the crane.

2. The crane according to claim 1, wherein the monitoring and simulation modes includes the calculation unit and/or is connected to the calculation unit, the parameters describing the current state of the crane are evaluated by the calculation unit and/or a possible state and/or a possible change in state of the crane are simulated and/or calculated by the calculation unit.

3. The crane according to claim 1, wherein the change in state and/or the possible change in state are calculated and modeled, preferably modeled in the form of at least one mathematical function, and/or the change in state and/or the possible change in state are represented as a graph or the bearing load curve (K1, K2, K3, K4, K5, K6), particularly a function bearing load curve (K1, K2, K3, K4, K5, K6) of the generated model, the actual state of the crane and/or the possible actual state of the crane are represented on the graph or on the bearing load curve (K1, K2, K3, K4, K5, K6), in particular with highlighting with respect to the surroundings.

4. The crane according to claim 1, wherein at least one of a luffing of an accessory boom, a luffing of a derrick boom, a setting of a derrick ballast, a change in the derrick ballast radius, a rotation of an upper carriage, a change in a spreading angle between stay racks in Y guying, the crane inclination and wind, are additionally included in the model.

5. The crane according to claim 1, wherein the change in state is a bearing load curve (K1, K2, K3, K4, K5, K6) of the crane, particularly a curve representing the bearing load of the crane, the bearing load curve (K1, K2, K3, K4, K5, K6) are preferably be represented graphically as a curve by the output unit and/or the bearing load is plotted on the y-axis or height axis and/or the actual state of the crane are represented on the represented bearing load curve as a bold-print point (P1, P2, P3, P4) or cross, and/or by the monitoring and simulation modes, the at least two-dimensional model are represented in the form of superposed curves in a plane and/or in the form of a perspective representation, preferably by a perspective representation of a characteristic zone or relief.

6. The crane according to claim 1, wherein the at least one monitor of the monitoring and simulation means (10) include at least one keypad (20, 22, 24, 26, 28) as the input unit and with at least one display as the output unit, or the monitoring and simulation modes is designed as a monitor with at least one keypad (20, 22, 24, 26, 28) as input unit and with at least one display (14) as output unit.

7. The crane according to claim 1, wherein the crane comprises at least two master switches which are connected or connectable to the monitoring and simulation modes, at least one first master switch is provided, by which the luffing movement of the boom is controlled directly and/or indirectly, and at least one second master switch is provided, by which the telescoping movement is controlled directly and/or indirectly, preferably, on the basis of the entries via the master switches and with the monitoring and simulation modes, the change in state, particularly the bearing load curve (K1, K2, K3, K4, K5, K6) of the crane, represented, and/or a possible state and/or possible change in state of the crane, particularly the bearing load curve (K1, K2, K3, K4, K5, K6) of the crane, simulated and/or represented.

8. The crane according to claim 7, wherein the master switch(es) are operated in at least one first and at least one second mode, in the first mode, at least one crane element is actuated, and in the second mode, by the master switch, entries are made to the monitoring and simulation modes, particularly using a TrackPoint and/or a PC mouse.

9. A monitoring and simulation mode for a crane, particularly a crawler crane or mobile crane, with the monitoring and simulation characteristics according to claim 1.

10. The crane according to claim 1, wherein the monitoring and simulation modes graphically display actual movement of the crane and/or components of the crane to a set position, simulated movement of the crane and/or components of the crane past the set position, and limits such as load limits upon prospective movement of the crane and/or components of the crane past the set position.

11. The crane according to claim 10, wherein the monitoring and simulation modes graphically display a maximum load bearing curve (K1) for a particular state of the crane and also a load bearing table from which the curve is calculated.

12. The crane according to claim 1, wherein the monitoring and simulation modes graphically display several maximum load bearing curves (K1, K2, K3, K4) in a three-dimensional graphic for different states of the crane and interconnect the load bearing curves with an additional curve (K5) in the three-dimensional graphic illustrating change in maximum load bearing (P1, P2, P3, P4) as the crane moves through the different states.

13. The crane according to claim 12, wherein the crane monitoring and simulation modes interconnect the load bearing curves with an additional curve (K6) illustrating change in maximum load bearing (P1', P2', P3', P4') as a function of simultaneous movement of the crane boom by luffing and telescoping.

14. The crane according to claim 1, wherein the crane monitoring and simulation modes graphically display a composite curve of the telescoping and luffing movements, with the luffing movement proportion or ratio being plotted along an x-axis, and the telescoping movement proportion/ratio being plotted along a y-axis, a tangent (T1) at a point on said composite curve that does not have a constant value denoting continuation of current movements, and the monitoring and simulation modes recalculating the tangent (T1) if movements change.

15. The crane according to claim 1, wherein the monitoring and simulation modes graphically display actual movement of the crane and/or components of the crane to a set position, simulated movement of the crane and/or components of the crane past the set position, and limits such as load limits upon prospective movement of the crane and/or components of the crane past the set position, and the monitoring and simulation modes graphically display several maximum load bearing curves (K1, K2, K3, K4) for different states of the crane and interconnect the load bearing curves with an additional curve (K5) illustrating change in maximum load bearing (P1, P2, P3, P4) as the crane moves through the different states.

16. The crane according to claim 1, wherein the second operating mode simulates planned virtual movement of the crane.

17. The crane according to claim 1, wherein the multidimensional model is generated further based on a third bearing load curve having two dimensions, wherein the first dimension of the third bearing load curve is associated with another varying lulling of the crane while holding constant telescoping of the crane at a third value, and the second dimension of the third bearing load curve is associated with the maximum bearing load of the crane, the third value being different from the first value.

18. The crane according to claim 17, wherein the second bearing load curve is generated based on the first bearing load curve and the third bearing load curve.

19. The crane according to claim 17, wherein the multidimensional model comprises a three-dimensional surface generated based on the first bearing load curve, the second bearing load curve and the third bearing load curve.

* * * * *